United States Patent [19]

Hoshino et al.

[11] Patent Number: 4,803,515

[45] Date of Patent: Feb. 7, 1989

[54] IMAGE FORMING APPARATUS

[75] Inventors: Osamu Hoshino; Kazuyoshi Chiku, both of Tokyo, Japan

[73] Assignee: Canon Kabushiki Kaisha, Tokyo, Japan

[21] Appl. No.: 67,539

[22] Filed: Jun. 29, 1987

[30] Foreign Application Priority Data

Jul. 3, 1986 [JP] Japan ..... 61-155134
Jul. 3, 1986 [JP] Japan ..... 61-155135

[51] Int. Cl.[4] ..... G03G 15/01
[52] U.S. Cl. ..... 355/4; 355/3 TR
[58] Field of Search ..... 355/3 R, 8, 14 R, 4, 355/3 TR, 14 TR; 346/157

[56] References Cited

U.S. PATENT DOCUMENTS 4,531,828 7/1985 Hoshino ..... 355/4 X
4,690,542 9/1987 Furuta et al. ..... 355/4

*Primary Examiner*—R. L. Moses
*Attorney, Agent, or Firm*—Fitzpatrick, Cella, Harper & Scinto

[57] ABSTRACT

An image forming apparatus includes a movable image bearing member; a driver for driving the image bearing member; elements for forming a latent image on the image bearing member; a developing device for developing the latent image formed on the image bearing member by the latent image forming elements; and a transferring device for transferring a developed image developed by the developing device onto an image receptor. The time interval required for the image bearing member to move from a latent image forming position, where the latent image forming elements form the latent image on the image bearing member, to a transfer position, where the transferring device transfers the developed image onto the image receptor, is an integer multiple of a period of the drive non-uniformity inherent in the driver.

12 Claims, 5 Drawing Sheets

IMAGE FORMING APPARATUS

BACKGROUND OF THE INVENTION

1. Field of the Invention and Related Art

The present invention relates to an image forming apparatus. More particularly, the present invention relates to a multi-color electrophotographic image forming apparatus in which a plurality of images are transferred and superimposed onto the same transfer material. The invention also relates to a multi-color electrophotographic image forming apparatus in which a plurality of electrophotographic photosensitive members are juxtaposed, on which images are formed through an electrophotographic process, and on which different color developed images are provided; these developed images are transferred onto an image receptor such as an image transfer material, an intermediate transfer material and continuous rolled paper fed to the developed images by a transfer material conveying device, whereby a multi-color image is formed by the sequential image transfer of the different color images. Applications of the present invention are not limited to electrophotographic color copying machines, but extend to various types of color printers or the like. For the sake of simplicity of explanation, a laser beam printer using an electrophotographic process is provided in this specification. An image bearing member such as the photosensitive member described above may be in any form, for example, in the form of a belt or a drum, as long as it is movable along an endless path, but for simplicity, the image bearing member will be described hereinafter as being in the form of a drum.

2. Description of Pertinent Information

Several different laser beam printers using an electrophotographic process have been proposed. One typical example is shown in FIG. 1.

In FIG. 1, an exemplary full-color laser beam printer is shown as having three image forming units Pa, Pb and Pc, each of which contains a photosensitive drum 1, 2 or 3 exclusively for the respective unit. Around each of the photosensitive drums, an image forming process means is disposed, although only a laser beam exposure means 4, 5 or 6 is shown. The process means may include known charging means, exposure means, developing means, transfer means, cleaning means and other necessary elements which are used in the known electrophotographic process. Below the photosensitive drum 1, 2 or 3, there is provided a transfer material conveying means 10 including a rotatable member or an endless belt 13, which is trained around rollers 11 and 12 and which is rotatable in the direction of an arrow to penetrate image transfer stations of the image forming units Pa, Pb and Pc. The transfer material conveying means 10 functions to convey the transfer material P fed from an unshown feeding station in the direction of the arrow through the transfer stations 7, 8 and 9 of the image forming units Pa, Pb and Pc.

In this structure, the first image forming unit Pa first forms a yellow toner visualized image on the photosensitive drum 1, which is then transferred at the transfer station 7 onto a transfer material P conveyed by the transfer material conveying means. While the yellow toner image is being transferred onto the transfer material P, the second image forming unit Pb produces a magenta toner visualized image on the photosensitive drum 2. The magenta toner image is transferred onto the transfer material P which now carries the toner image transferred from the first image forming unit Pa, when it is introduced into the transfer station 8 of the second image forming unit Pb. Similarly, while the magenta toner image is transferred onto the transfer material P, the third image forming unit Pc produces a cyan toner visualized image on the photosensitive drum 3, which is transferred onto the transfer material P now having the images transferred from the first image forming unit Pa and the second image forming unit Pb, when it is introduced into the transfer station 9 of the third image forming unit Pc.

If it is necessary or desirable to add a black toner image formation, a fourth (not shown) image forming unit may be employed.

In any case, when the superimposed transfer of the three or four color toner images are completed on the transfer material P, the transfer material P is conveyed to an image fixing station (not shown), where the superimposed images are fixed so that a permanent full-color image is formed on the transfer material P.

After the image transfer in each of the photosensitive drums, the cleaning means (not shown) removes the residual toner from the photosensitive member so as to prepare it for the next latent image formation.

The full-color image forming apparatus of this type is advantageous in that the overall process speed can be increased since the image forming units are provided for the respective colors and in that the passage of the transfer material can be made straight, and therefore, it is usable for thick paper or transparent film or the like. However, this apparatus has the problem of misregistering the color images formed by the different image forming units.

Misregistration of the transferred three or four color images appears as color misregistration or a variation in color. One of the causes for this misregistration has been found to be that the start position of the image transfer on the transfer material is different among the photosensitive drums due to nonuniform rotational drive of the photosensitive drums. In order to solve this problem, it has been proposed to couple a rotary encoder to the photosensitive drum, thus, accurately controlling the rotation of each of the photosensitive drum. This method has turned out to be able to provide good results, but the structure implementing this method and the control system are complicated, which leads to an increase in the cost.

With the development of dot matrix or raster line type image writing systems, for example, not only with multi-color laser beam printers but also with LED printers, and liquid crystal shutter printers or the like, the tolerance of the non-uniform speed of the image bearing member attributable to non-uniform rotational drive to the image bearing member, typically a photosensitive drum or the like, becomes very severe. For example, in the case of raster line system for producing an image at a density of 16 picture elements per mm, a correct pitch is 0.0625 mm, and an error of this pitch is seen as a non-uniform density by human eyes.

SUMMARY OF THE INVENTION

In order to solve those problems, the inventors have considered the driving method for the image bearing member and the control method for the image formation and have found that a driving means for driving the image bearing member has an inherent drive nonuniformity which is periodical. Based on this finding, good control can be obtained by setting time intervals associated with a movable member such as the image bearing member and/or an image receptor such as a transfer material in the image forming apparatus, corresponding to the period of the drive non-uniformity. As will be understood, the present invention has been achieved on the basis of this novel finding.

Accordingly, it is a principal object of the present invention to provide an image forming apparatus which is substantially free from non-uniform image density by using a simple structure, while allowing periodical drive non-uniformity of a drive means for driving an image bearing member.

It is another object of the present invention to provide an image forming apparatus wherein misregistration of the images transferred from an image bearing member to an image receptor such as a transfer material is effectively prevented, thus producing high quality color images without misregistration of color.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
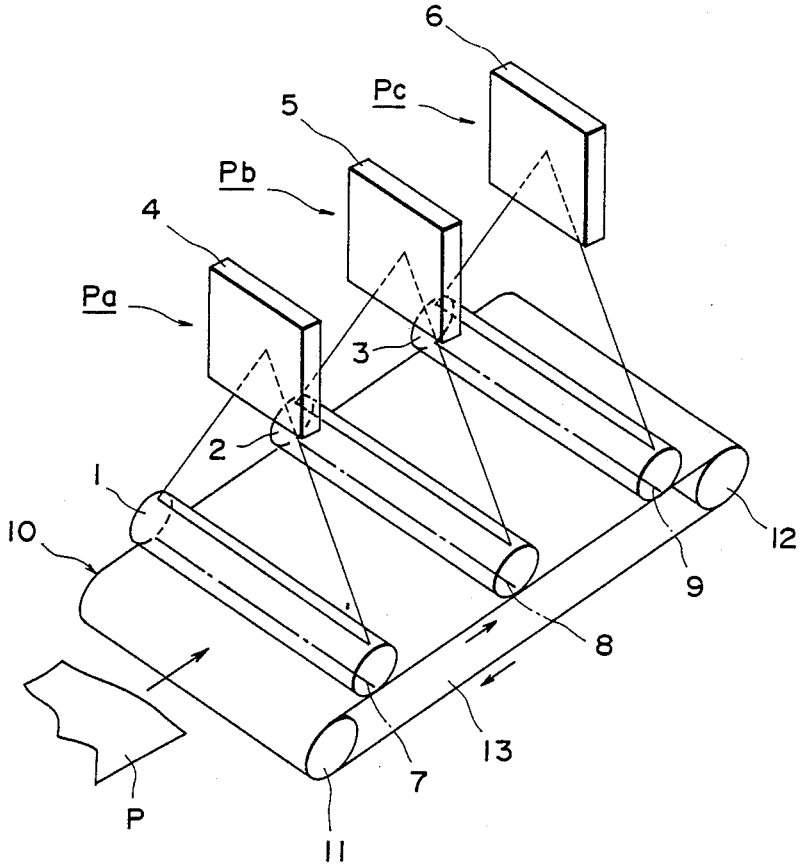
FIG. 1 is a schematic perspective view of an image forming apparatus to which the present invention is applicable.
Figure 2:
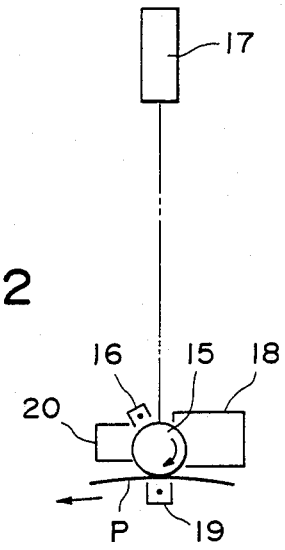
FIG. 2 is a schematic sectional view of an image forming apparatus, illustrating arrangements of image forming means.

Referring to FIG. 2, there is shown an electrophotographic image forming apparatus using a Carlson process which is known. The apparatus comprises an image bearing member 15 which is an electrophotographic photosensitive drum. Around the photosensitive drum 15, there are provided a charger 16, a laser beam optical scanning device 17 including a laser beam source, a polygonal scanning mirror and other necessary elements to write light signals indicative of image information on the photosensitive drum 15 to form a latent image thereon, a developing device 18 for visualizing the latent image formed on the photosensitive drum 15, a transfer discharger 19 for transferring the developed image from the photosensitive drum 15 onto the transfer material P, and a cleaner 20 for cleaning the residual image from the surface of the photosensitive drum 15. Those elements constitute an image forming means for forming an image on the photosensitive drum 15.

Figure 3:
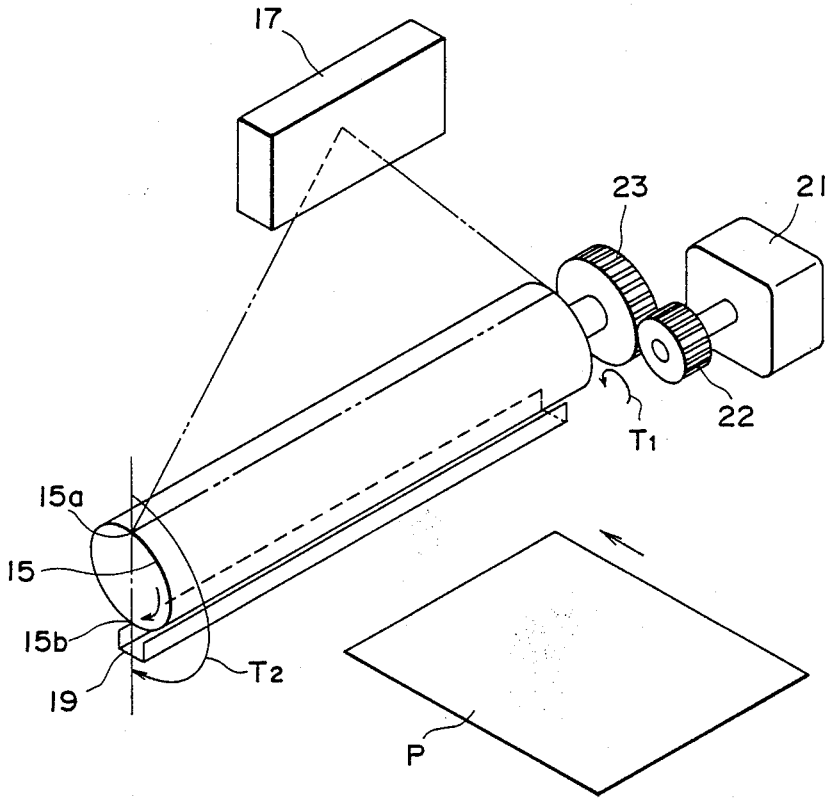
FIG. 3 is an enlarged perspective view of an image forming unit used in the apparatus shown in FIG. 2.

The photosensitive drum 15, as best seen in FIG. 3, is rotationally driven in the direction of the illustrated arrow by a driving means. The driving means, in this embodiment, includes an electric motor 21 and a driving gear 22 coupled to an output shaft of the motor 21. The driving gear 22 is meshed with a driven gear 23 fixed to the photosensitive drum 15 so as to rotationally drive the photosensitive drum 15. In FIG. 3, for the sake of simplicity of explanation regarding the driving system, the image forming means other than the image writing means 17 and the transfer discharger 19 are omitted.

The inventors' investigations and consideration have revealed that the driving means constituted by elements 21, 22 and 23 for driving the photosensitive drum 15 possesses an inherent drive non-uniformity which varies by a constant period. The non-uniformity is introduced from the driving means to the photosensitive drum 15, and it results in the non-uniform rotational speed of the photosensitive drum 15. The non-uniform speed of the photosensitive drum 15 expands or shrinks the latent image when the laser beam writes the image on the photosensitive drum 15 surface during image exposure step, and as a result, the visualized image transferred onto the transfer material is expanded or shrunk correspondingly.

According to the present invention, in order to solve the problem of the image expansion and shrinkage attributable to the non-uniform drive by the driving means, the photosensitive drum 15 is driven in such a controlled manner that the time required for a photosensitive drum 15 surface to move an image writing position 15*a* (latent image forming position) to the image transfer position 15*b* is an integer multiple of the period of the drive non-uniformity of the photosensitive drum driving means. In other words, the distance measured along the photosensitive member surface from the writing position 15*a* to the transfer position 15*b* is determined in such a manner as described above. More particularly, in this embodiment, the rotation period T1 of the gear 22 is a time interval T2 of the movement from the writing position 15*a* to the transfer position 15*b* divided by an integer. Because of this arrangement, an integrated pitch error (per one full turn) and/or an adjacent pitch error (per one tooth) attributable to the gear 22 at the time of image writing, is reproduced at the time of the image transfer as the same deviation that is introduced at the time of the writing.

Figure 4:
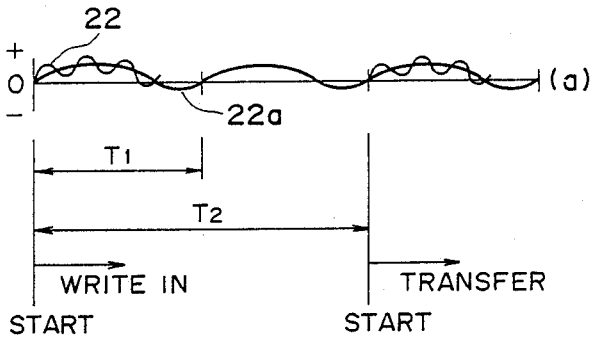
FIGS. 4 and 8 are graphs showing periodical non-uniformity of drive provided by a driving means in embodiments of the present invention.

It is assumed that the integer is "2", that is, the rotational period T1 of the gear 22 is set to be the time interval of the movement between the exposure position 15*a* to the transer position 15*b* divided by "2". As shown in FIG. 4, the pitch error (a) is a combination of a component 22*a* caused by eccentricity of the gear 22 and an adjacent pitch error 22*b*. Since T1 is one half of T2, the non-uniform speed of the photosensitive drum 15 produced by the gear 22 at the time of writing the image formation occurs at the image transfer position at T2 thereafter as an exact reproduction of the non-uniformity. Therefore, the expansion, for example, introduced at the time of the image writing is transferred in a shrinking manner on the transfer material P just as if the expansion is corrected, since the photosensitive drum 15 moved at a higher speed at the time of the image transfer so that it passes through the transfer station at the higher speed. In this manner, the transferred image is of correct size on the transfer material since the pitch error of the driving means is corrected back and removed. Thus, the non-uniformity of the image can be eliminated.

In FIG. 4, "0" indicates a predetermined rotational angle position of the motor, and "+" represents an advanced angle from the predetermined angle, whereas "−" indicates a delayed angle with respect to the predetermined angle.

Figure 5:
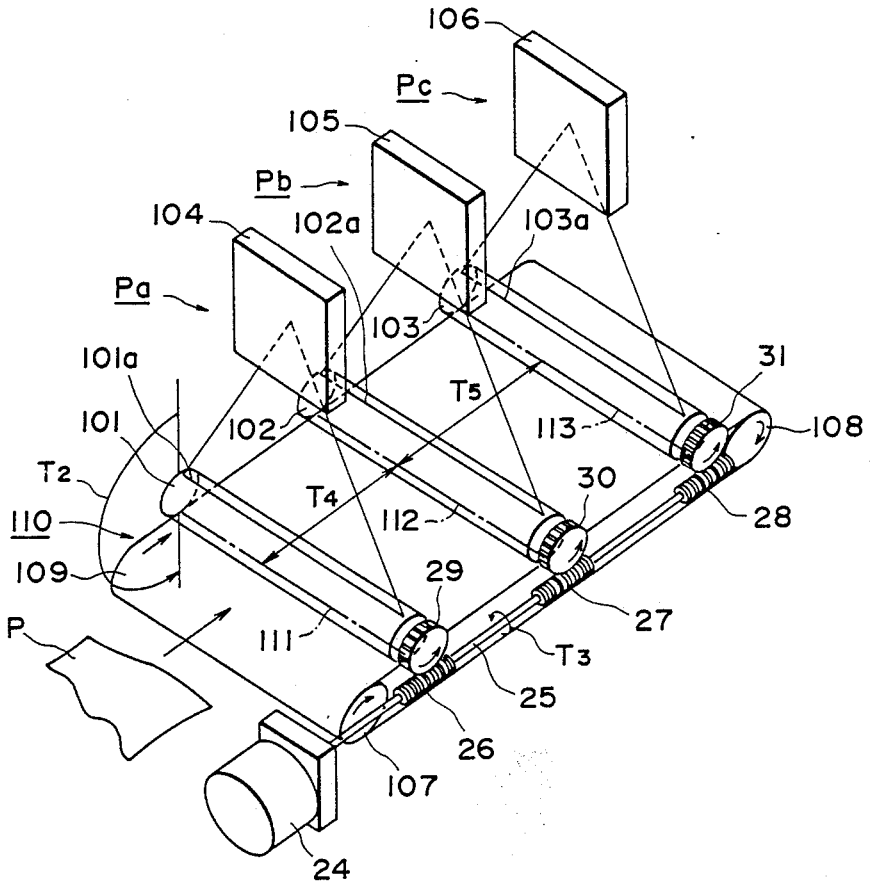
FIGS. 5, 6 and 7 are perspective views of color image forming apparatuses according to embodiments of the present invention.
Figure 6:
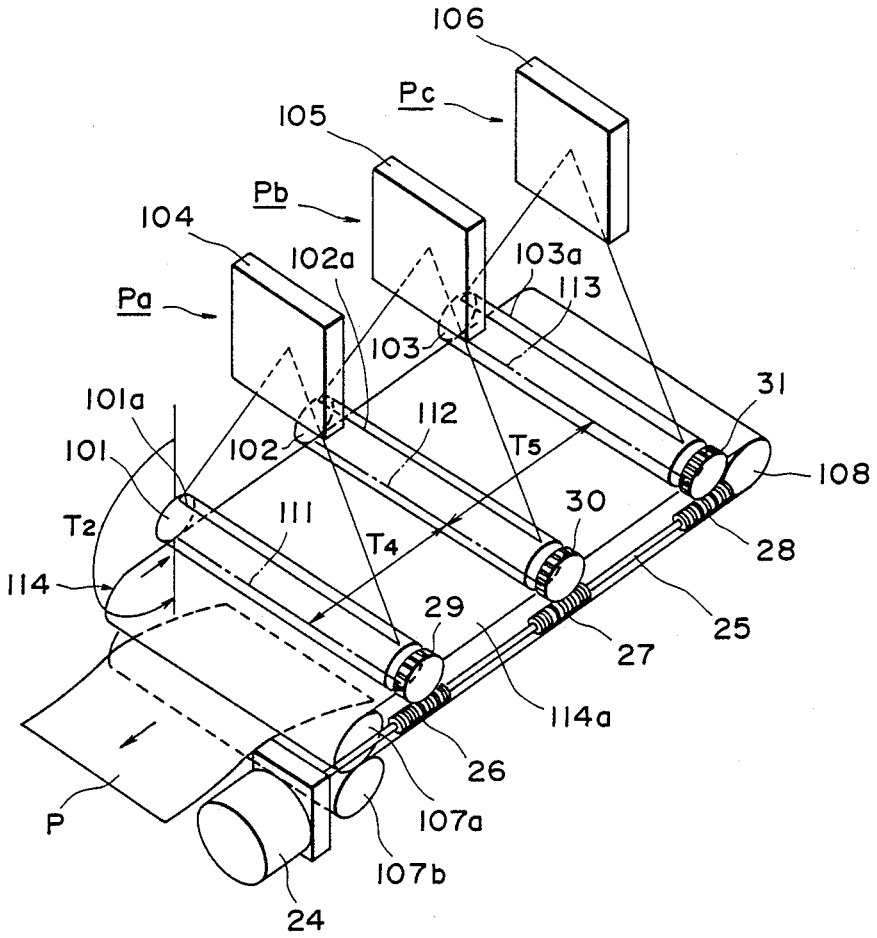
Figure 7:
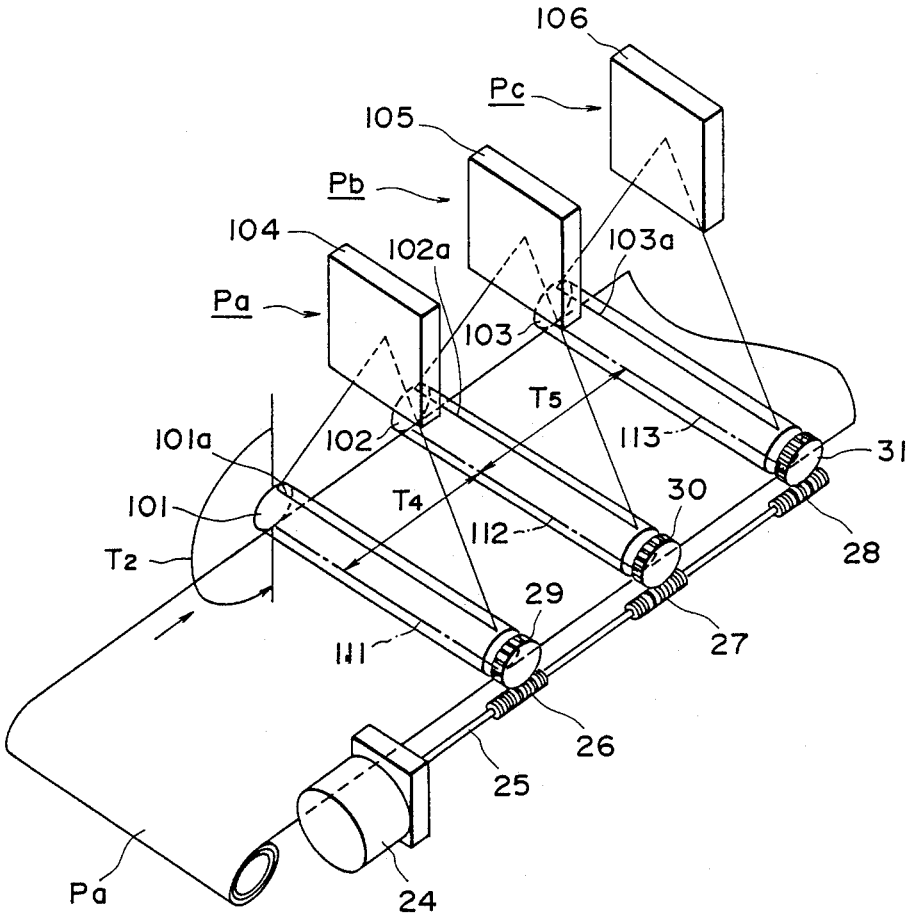
Figure 8:
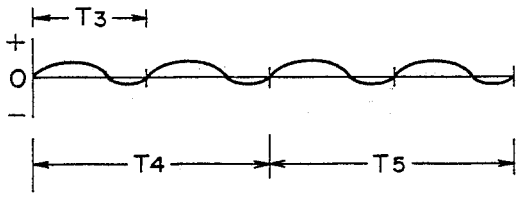

FIGS. 5–7 illustrate other embodiments of the present invention, wherein the present invention is used with a color laser beam printer of an electrophotographic type.

In FIG. 5, the full-color laser beam printer includes three image forming units Pa, Pb and Pc. Each of the image forming units contains a photosensitive drum 101, 102 or 103 exclusively for the associated unit. Around each of the photosensitive drum 101, 102 or 103, an image forming means exclusively for the associated unit is disposed. The image forming means is constituted by a laser beam scanning means 104, 105 or 106 and other unshown element such as those disclosed in FIG. 2, i.e. charging means, developing means, transfer means and cleaning means. Below each photosensitive drum 101, 102 or 103, a transfer material conveying means 110 is disposed, which includes an endless belt 109 rotatable in the direction of an arrow and trained about rollers 107 and 108 so as to pass through the transfer positions of the respective image forming units Pa, Pb and Pc. The transfer material conveying means 110 functions to convey in the direction of the arrow through the transfer position 111, 112 and 113 of the image forming units Pa, Pb and Pc the transfer material P fed from an unshown transfer material feeding device.

In this structure, the first image forming unit Pa first forms an yellow toner visualized image on the photosensitive drum 101, which image is transferred at the transfer position 111 to the transfer material P conveyed by the transfer material conveying means 110. While the yellow toner image is being transferred onto the transfer sheet P, the second image forming unit Pb produces a magenta toner visualized image on the photosensitive drum 102. When the transfer material P having received the image from the first image forming unit Pa is introduced into the transfer station 112 of the second image forming unit Pb, the magenta toner image by the second image forming unit Pb is transferred onto the transfer material P. While the magenta toner image is being transferred onto the transfer material P in the second image forming unit, the third image forming unit Pc downstream thereof operates to form a cyan toner visualized image on the photosensitive drum 103. Then, when the transfer sheet P now having received the image from the second image forming unit Pb is conveyed into the transfer station 113 of the third image forming unit Pc, the cyan toner image is transferred onto the transfer material P.

If an additional black toner image is required or desired, an additional, that is, fourth image forming unit (not shown) may be provided.

In any case, after the three or four color toner images are superimposed on the same transfer material P, the tranfer material P is advanced to an image fixing station (not shown) where the image is fixed onto the transfer sheet P into a permanent multicolor (full-color) image.

After completion of the image transfer, each of the photosensitive drums 101, 102 and 103 is cleaned by the cleaning means (not shown) so as to become free of the residual toner and to be prepared for the next latent image forming operation.

In this embodiment, the transfer discharger having the same structure as shown in FIG. 2, is disposed inside the endless belt assembly 109 corresponding to each of the transfer stations 111, 112 and 113 for the photosensitive drums 101, 102 and 103 so as to be opposed to the associated drum.

At least two, (all in this embodiment) of the photosensitive drums 101, 102 and 103 are driven by a common driving means. More particularly, in this embodiment the driving means includes an electric motor 24, a driving shaft 25 connected to the driving motor 24, and the photosensitive drums 101, 102 and 103 are driven by the motor 24 through respective worm gears 26, 27 and 28 formed on the common driving shaft 25 and through warm wheels 29, 30 and 31 fixedly mounted to an end of the respective photosensitive drums.

According to this invention incorporated in this embodiment, each of the photosensitive drum 101, 102 and 103 driven by the common driving means 24 and 25 is driven such that a time interval T2 required for a surface portion of the photosensitive drum to move from the image writing position 101*a*, 102*a* or 103*a* (by the laser beam optical scanning device 104, 105 or 106) to the associated transfer position 111, 112 or 113 (the time interval T2 is indicated for the photosensitive drum 101 only in FIG. 5) is an integer multiple of the drive non-uniformity period T3 of the driving means (of course, the photosensitive drums may be driven by different and independent driving means in this case).

The photosensitive drums 101, 102 and 103 are disposed at predetermined intervals in this embodiment. The FIG. 5 arrangement is such that time intervals T4 and T5 required for the transfer material P to pass from the transfer position 111 for the photosensitive drum 101 to the transfer position 112 for the photosensitive drum 102 and for the transfer sheet P to pass from the transfer position 112 to the transfer position 113, respectively (the interval T5 may be equal to the interval T4), are equal to an integer multiple of a drive non-uniformity period inherent to the driving means 24 and 25, T3.

When the photosensitive drums 101, 102 and 103 are driven, an expansion, for example, of a latent image introduced at the time of image writing similar to the previous embodiment, is corrected back at the time of image transfer onto the transfer material P as the expanded image is transferred in a shrinked manner, since the photosensitive drum surface moves at a higher speed than the predetermined speed as in the case of latent image formation, and therefore, passes through the transfer position at the higher speed. As a result, the image is formed on the transfer sheet in a correct size. The pitch error of the driving means is corrected back and is eliminated, and simultaneously the image misregistration among the image forming stations attributable to the driving uniformity in the period of T3 is also eliminated due to the distance between the adjacent transfer stations determined in the manner described above with respect to this embodiment.

The foregoing embodiments relate to a laser beam printer of a multi-color electrophotographic type wherein a sheet of transfer material P conveyed by a transfer sheet conveying means 110 having a belt sequentially receives developed images to provide a transfer color image. However, the present invention is applicable to a multi-color electrophotographic image forming apparatus wherein the developed images are sequentially transferred onto an intermediate transfer material or a continuous rolled or fan-fold image receptor so as to provide a color image thereon. FIGS. 6 and 7 show other embodiments of the present invention.

In the FIG. 6 embodiment, the developed images formed on the photosensitive drums 101, 102 and 103 are once transferred onto an intermediate transfer material, and then, the visualized image on the intermediate transfer material is transferred onto a final transfer material. Below each of the photosensitive drums 101, 102 and 103, there is an intermediate transfer material conveying means 114, which has substantially the same structure as the transfer material conveying means 110 described in connection with FIG. 5 embodiment, with the exception that an intermediate transfer material 114*a* in the form of a belt is used in place of the conveying belt 109, which is made of polyester film, polyimide film, silicone rubber or urethane rubber or the like. In this embodiment, the developed images once transferred onto the same intermediate transfer material 114*a* are further transferred onto a final transfer material P, and therefore, the trahsfer material P fed from the feeding device (not shown) is pressed against the intermediate transfer material 114*a*. To accomplish this, transfer rollers 107*a* and 107*b* are used in place of the drum 107 in FIG. 5. The same advantageous effects are provided in this embodiment as in FIG. 5 embodiment.

In the FIG. 7 embodiment, the developed images formed on the photosensitive drums 101, 102 and 103 are sequentially transferred onto an image receptor in the form of continuous paper Pa in a multi-color electrophotographic image forming apparatus. In this embodiment, below each of the photosensitive drums 101, 102 and 103, the transfer sheet Pa supplied from an unshown supply roll is disposed so as to directly receive the image from the photosensitive drum. After all the images are transferred, it is cut into a sheet of a desired length, if necessary. This is similar to the FIG. 5 embodiment in that the continuous paper Pa is used in place of the conveying belt 109 of the transfer material conveying means.

As will be understood, the same advantageous effects are provided as in FIG. 5 embodiment.

It is added that in the embodiments of FIGS. 6 and 7, the transfer discharger (not shown) are used for the transfer stations 111, 112 and 113, respectively.

In FIGS. 5, 6 and 7 embodiments, the drive transmitting means from the driving means 24 and 25 to the photosensitive drum has been described as being constituted by a worm gear and a worm wheel, but this is not limiting, and it is possible to use bevel gear mechanism, for example. The driving means may be other than a combination of the electric motor 24 and the driving shaft 25.

As described in the foregoing, according to the present invention, a high quality image can be formed without non-uniformity of image density by using a simple structure, while retaining the periodical drive non-uniformity of a drive means for the image bearing member in an image forming apparatus. Additionally, color misregistration among images transferred onto the same image receptor such as a transfer material from image bearing members, attributable to the driving non-uniformity of the image bearing member, can be eliminated, so that a high quality color image can be provided.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

a movable image bearing member;

driving means for driving said image bearing member;

means for forming a latent image on said image bearing member;

developing means for developing the latent image formed on said image bearing member by said latent image forming means; and means for transferring a developed image developed by said developing means onto an image receptor;

wherein the time interval required for said image bearing member to move from a latent image forming position at which said latent image forming means forms the latent image on said image bearing member to a transfer position at which said transfer means transfers the developed image onto the image receptor is an integer multiple of a period of a drive non-uniformity inherent in said driving means.

2. An apparatus according to claim 1, further comprising a plurality of said movable image bearing members are disposed along a direction of movement of the image receptor for receiving the developed image.

3. An apparatus according to claim 2, wherein said driving means is common to said plurality of image bearing members.

4. An apparatus according ot claim 2, further comprising a plurality of said image forming means and a plurality of said developing means forming different color developed images on said plurality of movable image bearing members, respectively, and wherein when the image receptor passes through the transfer positions of the respective plurality of image bearing members, the different color developed images are sequentially transferred onto the image receptor to provide a multi-color image.

5. An apparatus according to claim 3, wherein the time period required for the image receptor to move between adjacent transfer positions is an integer multiple of the period of drive non-uniformity inherent in the driving means.

6. An apparatus according to claim 3, further comprising a plurality of said image forming means and a plurality of said developing means forming different color developed images on said plurality of movable image bearing members, respectively, and wherein when the image receptor passes through the transfer positions of the respective plurality of image bearing members, the different color developed images are sequentially transferred onto the image receptor to provide a multi-color image.

7. An apparatus according to claim 5, further comprising a plurality of said image forming means and a plurality of said developing means forming different color developed image on said plurality of movable image bearing members, respectively, and wherein when the image receptor passes through the transfer positions of the respective plurality of image bearing members, the different color developed images are sequentially transferred onto the image receptor to provide a multi-color image.

8. An apparatus according to claim 1, wherein said image forming means includes laser beam optical scanning means.

9. An image forming apparatus, comprising:

a plurality of movable image bearing members;

a common driving means for driving said plurality of image bearing members;

a plurality of image forming means for forming images on said plurality of image bearing members, respectively; and means for moving an image receptor through respective image transfer positions of said plurality of image bearing members to receive the images formed on said plurality of image bearing members;

wherein the time interval required for the image receptor to move between the transfer positions of adjacent image bearing members is an integer multiple of a period of drive non-uniformity inherent in said common driving means.

10. An apparatus according to claim 9, wherein said plurality of image bearing members are disposed along a direction of movement of the image receptor.

11. An apparatus according to claim 10, wherein said plurality of image forming means form different color images on respective image bearing members, and are sequentially transferred onto the image receptor, whereby a multi-color image is formed on the image receptor.

12. An apparatus according to claim 9, wherein said image forming means includes laser beam optical scanning means.

* * * * *

UNITED STATES PATENT AND TRADEMARK OFFICE

CERTIFICATE OF CORRECTION

PATENT NO. : 4,803,515

DATED : February 7, 1989

INVENTOR(S) : Osamu Hoshino, et al.

It is certified that error appears in the above-identified patent and that said Letters Patent is hereby corrected as shown below:

AT [57]:

Line 15, "a period of the" should read --the period of a--.

COLUMN 2:

Line 43, "drum" should read --drums--.

COLUMN 4:

Line 6, "consideration" should read --considerations--.

Line 45, "transer position 15b" should read --transfer position 15b--.

COLUMN 5:

Line 23, "position 111, 112 and 113" should read --positions 111, 112 and 113--.

Line 27, "an" should read --a--.

Line 55, "tranfer material P" should read --transfer material P--.

UNITED STATES PATENT AND TRADEMARK OFFICE

CERTIFICATE OF CORRECTION

PATENT NO. : 4,803,515

DATED : February 7, 1989

INVENTOR(S) : Osamu Hoshino , et al.

It is certified that error appears in the above-identified patent and that said Letters Patent is hereby corrected as shown below:

COLUMN 6:

Line 9, "warm wheels 29, 30 and 31" should read --worm wheels 29, 30 and 31--.

Line 40, "shrinked" should read --shrunken--.

COLUMN 7:

Line 6, "with FIG. 5" should read --with the FIG. 5--.

Line 14, "trahsfer material P" should read --transfer material P--.

Line 19, "in FIG. 5" should read --in the FIG. 5--.

Line 35, "in FIG. 5" should read --in the FIG. 5--.

Line 39, "In FIGS 5, 6 and 7" should read --In the FIGS. 5, 6 and 7--.

COLUMN 8:

Line 21, "are" should be deleted.

Line 26, "ot" should read --to--.

Line 55, "image" should read --images--.

UNITED STATES PATENT AND TRADEMARK OFFICE

CERTIFICATE OF CORRECTION

PATENT NO. : 4,803,515 Page 3 of 3

DATED : February 7, 1989

INVENTOR(S) : Osamu Hoshino , et al.

It is certified that error appears in the above-identified patent and that said Letters Patent is hereby corrected as shown below:

COLUMN 9:

Line 12, "of drive" should read --of a drive--.

Signed and Sealed this

Second Day of January, 1990

*Attest:*

JEFFREY M. SAMUELS

*Attesting Officer* *Acting Commissioner of Patents and Trademarks*